US005289881A

United States Patent [19]

Schuh

[11] Patent Number: 5,289,881

[45] Date of Patent: Mar. 1, 1994

[54] HORIZONTAL WELL COMPLETION

[76] Inventor: Frank J. Schuh, 5808 Wavertree, Plano, Tex. 75075

[21] Appl. No.: 678,725

[22] Filed: Apr. 1, 1991

[51] Int. Cl.[5] ..... E21B 43/24

[52] U.S. Cl. ..... 166/303; 166/50

[58] Field of Search ..... 166/303, 272, 57, 62, 166/50, 97.5, 316

[56] References Cited

U.S. PATENT DOCUMENTS

| | | | |
|---|---|---|---|
| 3,399,623 | 9/1968 | Creed | 166/62 |
| 3,511,282 | 5/1970 | Willhite | 138/113 |
| 3,613,792 | 10/1971 | Hyde et al. | 166/57 X |
| 3,861,469 | 1/1975 | Bayless et al. | 166/303 |
| 3,994,340 | 11/1976 | Anderson et al. | 166/50 X |
| 4,099,570 | 7/1978 | Vandergrift | 166/50 X |
| 4,116,275 | 9/1978 | Butler et al. | 166/50 X |
| 4,421,163 | 12/1983 | Tuttle | 166/59 |
| 4,460,044 | 7/1984 | Porter | 166/50 X |
| 4,480,695 | 11/1984 | Anderson | 166/50 |
| 4,532,994 | 8/1985 | Toma et al. | 166/303 |
| 4,565,245 | 1/1986 | Mimo et al. | 166/50 |
| 4,605,069 | 8/1986 | McClaflin et al. | 166/372 X |
| 4,640,359 | 2/1987 | Livesey et al. | 166/276 |
| 4,696,345 | 9/1987 | Hsueh | 166/50 X |
| 4,726,420 | 2/1988 | Weeks | 166/372 X |
| 4,878,539 | 11/1989 | Anders | 166/50 X |
| 4,942,926 | 7/1990 | Lessi | 166/385 |
| 5,054,551 | 10/1991 | Duerksen | 166/50 X |
| 5,141,054 | 8/1992 | Alameddine et al. | 166/50 X |
| 5,148,869 | 9/1992 | Sanchez | 166/303 |

*Primary Examiner*—Hoang C. Dang
*Attorney, Agent, or Firm*—Morgan L. Crow

[57] ABSTRACT

A horizontal well completion apparatus and method for heavy, viscous oil in a producing zone (14) are disclosed using a single well. Hot injection fluid is injected into an injection string (20), reduced to a lower pressure by passing the injection fluid through a choke (22). A packer (26) separates the upper well annulus (40) from the lower well annulus (42). Insulation (21) surrounds injection tubing string (20) between the packer (26) and the well head (11). Perforations (18) in the horizontal portion (12) of the well allow heated oil to flow into the lower annulus 42 in the horizontal portion (12) of the well where is picked up by the injected fluid and lifted to the surface of the well by a jet pump (28). Temperature and pressure in the lower well annulus 42 are controlled by the temperature and pressure of the injection fluid, and the pumping rate of the produced fluids.

9 Claims, 2 Drawing Sheets

HORIZONTAL WELL COMPLETION

BACKGROUND OF THE INVENTION

The Field of the Invention relates to the drilling, completion and production of wells drilled into formations containing heavy, viscous hydrocarbons. These hydrocarbons may be referred to as bitumen or tar. The invention relates to the drilling of a well bore substantially vertically downwardly, then curving the well bore out into a substantially horizontal portion, then thermal treatment and production of the viscous hydrocarbons from the producing formation.

The heavy, viscous hydrocarbons are valuable for refining. The refined products can be used as the basis for road paving and plastics. Such formations as may be near the earth surface can be strip mined to recover the hydrocarbons. Many producing zones, however, are deeper, and may be a few hundred feet or several thousand feet below the earth surface. For purposes of this specification, producing zone and producing formation have the same meaning. For purposes of this specification, tubing placed in a well casing may also be referred to as a tubing string, and surface means at or near the earth surface unless otherwise referenced.

Heavy hydrocarbon, also known as heavy crude oil, can have American Petroleum Institute (API) density from about 8 up to 20 or more. Lower API density numbers indicate greater specific gravity. API 10 has a specific gravity of 1. Such heavy crude oils are very viscous, and are essentially solid at in situ (in place) temperatures.

Recovery of such heavy crude oil has been accomplished in the past by heating. Steam is been injected through a well into a producing formation for a time, then the well is produced.

This process is referred to as the "huff and puff" method. With several vertical wells drilled into a zone, several wells may be produced with the "huff and puff" process. After sufficient oil has been removed from the formation, communication may be established from one well to another. Then a continuous flood of steam may be injected into one well. A mixture of heated oil, condensate and steam may then be produced from an adjacent well. This process is known a continuous steam flood.

The Related Prior Art includes U.S. Pat. No. 4,565,245, in which Mims et al. teach the method and apparatus of a system of single well completion for carrying a hot stimulating agent into a tar sand from the remote end of the well. A progressively movable barrier is used to extend the flow path pattern in the producing formation. No provision is made to lift fluids from the remote end of the casing. The use of a barrier in the casing indicates the use of a heated flooding process rather than the use of heat conduction in combination with gravity in this invention to cause hydrocarbons to flow to the well bore. Mims also teaches that movement of the barrier is needed during the producing life of the formation.

In U.S. Pat. No. 4,640,359, Livesay teaches the method and apparatus for use in a single well for conducting a hot thermal stimulating medium to the remote end of the well. An expandable diverter forms a barrier which is progressively lengthened to cause the stimulating medium to sweep progressively increasing lengths of the producing formation.

SUMMARY OF THE INVENTION

There is disclosed the system of completion and production of heavy oil from a well comprising a well casing disposed in a well bore. The well and casing have a substantially horizontal portion disposed in an earth formation containing heavy oil. The well casing has perforations in the horizontal portion. A well head is provided at the top end of the well casing. An injection tubing string is extended from the well head into the horizontal portion of the well casing. A packer seals the casing between the perforations and the well head. A production tubing string extends from the well head through and seals with the packer, and a choke restricts flow in the injection string. The choke is positioned beyond at least a portion of the perforations in the casing, whereby heated fluid may be circulated into the injection string, through the choke, out of the injection tubing string, through a portion of the horizontal portion of the casing, enter the production tubing string and return to the well head through the production tubing string. My invention may also include a jet pump in the production string above the packer. A jet pump implies a power fluid string extending from the well head operably connected to the jet pump to power the jet pump. In this invention, the horizontal portion of the well bore and well casing is desirably disposed in the lower portion of the earth formation containing heavy oil.

DESCRIPTION OF THE PREFERRED EMBODIMENT

Figures 1, 2:
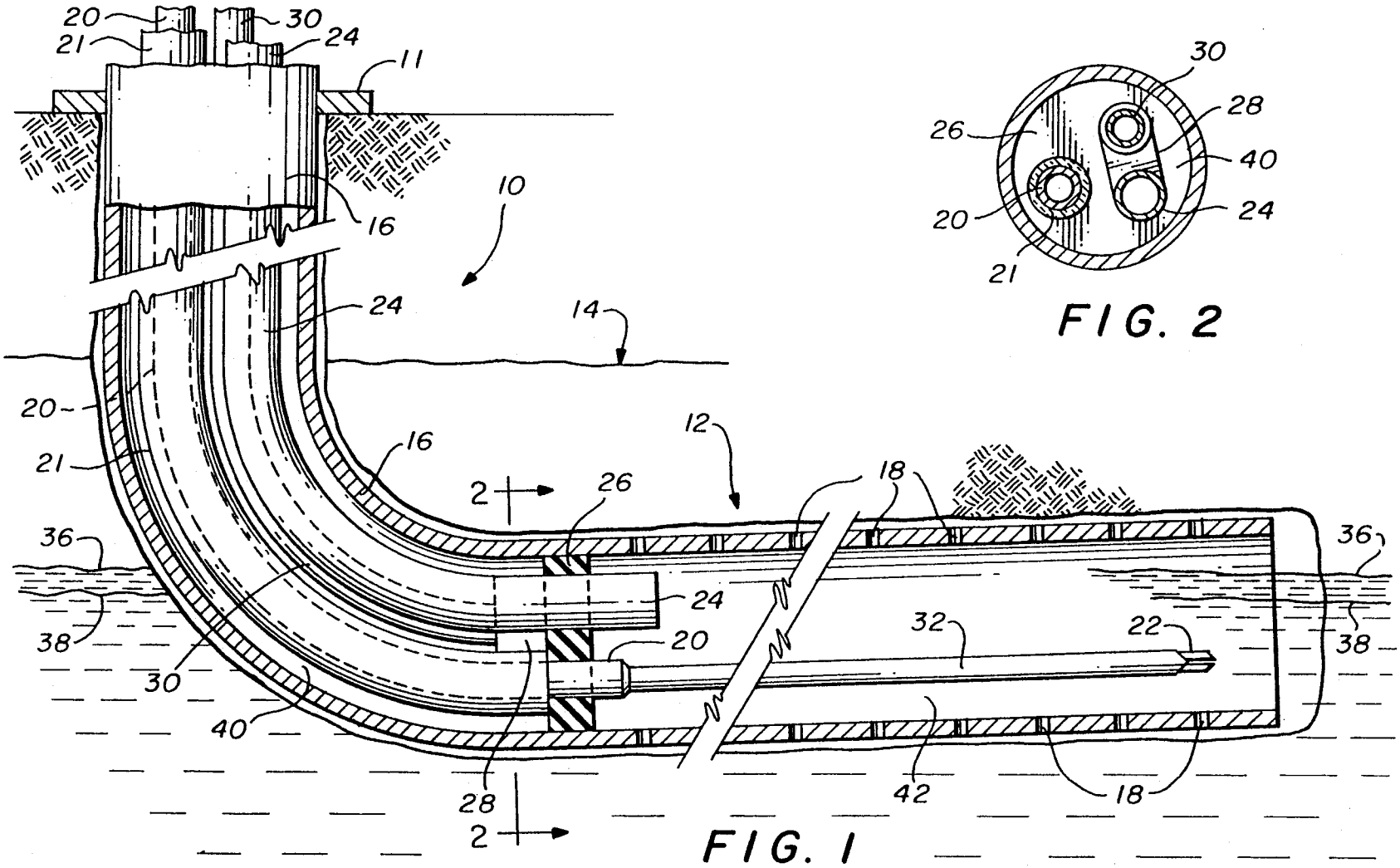
FIG. 1 is a perspective view of the preferred embodiment in this invention.
FIG. 2 is a cross section of the well of the preferred embodiment of this invention.

In FIG. 1 there is shown generally at 10 a perspective view of a well according to this invention. The well is drilled from the surface of the earth down in a generally vertical direction, then deviated by any of a number of methods well known in the industry. The well is curved so that the generally horizontal portion 12 of the well is drilled within the producing zone 14 and generally parallel to the bottom limit of the producing zone. The horizontal section 12 of the well can be of considerable length, up to 5000 feet or more. The reservoir also known as the producing zone 14 most desirable for application of my invention is a high permeability clean sandstone that contains a very viscous oil. The producing zone desirably is consolidated, rather than being, for example, loose sand. A producing zone of loose unconsolidated sand can be produced according to this invention by making provision to control the flow of the sand. These methods and apparatus are well known in the industry. A steel casing string 16 is run into the well bore and cemented in place as is well known in the industry. A well head 11 is installed at the surface of the earth to seal the well casing and to seal and support any tubing strings suspended within the casing. The casing is then perforated with perforations 18 along the length of the portion of the casing 16 within the producing zone. The far greater number of perforations in the casing draining a far greater volume of producing zone in near proximity to the well bore are advantages within the prior art that are gained by the horizontal well completion as described in this paragraph.

A steam injection tubing string 20 inserted into the well casing 16 is fitted with a choke 22 at or near the end of the tubing 20 remote from the surface. A production tubing string 24 is inserted into the casing 16 to conduct the produced hydrocarbons, condensate and possibly steam from the bottom of the casing 16. A packer 26 seals between the casing 16, the injection tubing 20 and the production tubing 24. The packer 26 has a flow passage sealed to the production string and communicating the production string through the packer. The packer 26 is positioned in the casing 16 near the perforations 18 between the perforations 18 and the surface. The packer 26 thereby seals between the annulus 40 above the packer 26 and the annulus 42 below the packer. The annulus 40 is the space inside the casing 16, above the packer 26 and outside any tubing strings in the casing 16. The portion of the steam injection tubing 20 in the annulus 40 is surrounded by thermal insulation 21 to reduce the transfer of heat from the steam in tubing 20 to the formation adjacent to the well. See FIG. 2. Any fluid left in the annulus 40 above the packer at the start of steam injection would eventually be expected to boil away from heat transferred from the injection tubing 20. As an option, this annulus 40 may be evacuated during the completion procedure by methods well known in the industry, therefore these procedures will not be described here. The air or vapor left in the annulus 40 performs an additional insulating effect to reduce heat loss from the injection tubing 20 in addition to the effect of insulation 21.

A jet pump 28 is the preferred device to lift the fluids from the bottom of the well to the surface. A jet pump is a device well known in the industry. A power fluid line 30 connects the surface to the jet pump 28. Fluid pumped from the surface down power fluid line 30 passes through a venturi in the jet pump 28 as is known in the industry. The venturi reduces the pressure at the inlet to the jet pump 28 to mix any fluids present at the pump inlet with the power fluid and lift the mixture to the surface through the production tubing string 24. In this manner, the jet pump 28 can lift the heated hydrocarbons, condensate, steam, even solids, and any gas without any moving mechanical parts in the well. Moving mechanical parts as in a mechanical pump would have frequent malfunctions due to the orientation of the well bore, the temperature at the pump and problems from solids carried by the produced fluids. A person skilled in the art can appreciate that although the target producing zone 14 is consolidated, loose, unconsolidated sand can be entrained and pumped to the surface with the jet pump 28.

A conventional steam generator at the surface, not shown, is used to heat the water for injection into the well through injection tubing 20. When water is heated, the maximum temperature to which the liquid can be heated is dependent on the pressure of the liquid. The water may be heated to the vaporization temperature for the injection pressure. If sufficient heat is added to the water in the steam generator, the water may be vaporized into steam. A feed water pump for the steam generator, not shown, supplies the pressure to move the water through the steam generator, to the injection tubing 20, and through the choke 22, through the perforations 18 in the casing. It can be readily seen by those skilled in the art that the water or steam pressure will be reduced upon passing through the flow restriction of the choke. Upon this pressure reduction, the saturation temperature of the water will be reduced, and therefore, the temperature of the water will be reduced to this saturation temperature. The pressure in the formation will be controlled by the flow rate of steam and water injected and the flow rate of the production flow as controlled by the jet pump 28, in combination with the pressure drop of the flow through choke 22 through the perforations 18, through the producing zone 14, and to the jet pump 28.

The steam injection tubing 20 in the annulus 40 is surrounded by thermal insulation 21 as mentioned above. The substantially horizontal portion of the injection tubing 32 beyond the packer 26 is not thermally insulated. Initially, the annulus 42 below the packer would be filled with steam or water, depending on the temperature and pressure. Heat will be transferred from the injection tubing 32 into the producing zone 14. The heat will reduce the viscosity of the heavy hydrocarbons in place so the steam, water and condensate flow will cause the hydrocarbons to flow from the producing zone 14 by gravity to the jet pump where the mixture will be lifted to the surface. There, the hydrocarbons maY be separated from the water and recovered for use. Start up and production according to this invention will be described hereinafter.

Referring now to FIG. 2, the cross section of the preferred embodiment of the invention shows the casing 16, the steam injection tubing string 20, the production tubing string 24 and the power fluid line 30 for the jet pump. Thermal insulation 21 surrounds injection tubing string 20.

The packer 26 with two flow passages may be selected from several types of hardware known and currently available in the industry. The production tubing string and power tubing string may be lowered into the casing individually in sequence according to known technology.

Upon installation of the completion equipment as illustrated in FIG. 1 and FIG. 2, production may be started. Steam or hot water is injected into the injection string 20 at the surface. An efficient plan is to pump the water into a steam generator (not shown), then into the injection string 20, at such a flow rate as to establish sufficient pressure to heat the water to a temperature to heat the producing zone 14 to a temperature sufficient to liquify the heavy oil in the producing zone 14. Heat transfers from the horizontal portion 32 of the injection string. Since this portion of the injection string is not insulated, heat is transferred into the producing zone 14 throughout the entire length of the horizontal section 32. This horizontal section 32 may be 5000 feet or more in length. When the steam or water passes through the choke 22, the pressure is reduced beyond the choke. Power fluid is pumped into the jet pump power fluid string 30. Fluids in the annulus 42 of the casing below the packer are picked up by the jet pump 28 and pumped the surface. The pressure, and therefore the temperature, in the horizontal portion 12 of the casing is controlled by the flow rate of the injection fluid going in, and the flow rate of the power fluid for the jet pump controlling the flow rate of the fluids removed from the horizontal section 12 of the casing. For example, if the pressure was atmospheric, the steam would condense at 212 degrees Fahrenheit. At a pressure of 500 psi, the condensing (saturated) temperature of water is 467 degrees F. Unless the well were very shallow, and without the jet pump, the bottomhole pressure would be quite high, and the saturated steam temperature would be quite high. The steam injection string 20 would have approximately the same temperature as the injection temperature. The production string would receive the fluids at the saturation temperature of the flow after the pressure drop at the choke and with the pressure controlled by the flow induced by the jet pump.

As the heavy oil in the producing zone 14 is heated by the injection fluid, gravity will perform an important role in causing the oil to flow into the perforations 18 in the casing 12. The flow of the injected fluids from the far end of the well to the jet pump 28 will sweep the oil which flows into and through the casing 12 to the jet pump 28 to be lifted to the surface for separation from the power fluid and injection fluid. As the heated fluid passes through the choke to a lower pressure, some of the water will flash into steam, and rise to the uppermost volume available. As the steam heats the viscous oil at the top of the open reservoir volume, the heated oil will have reduced viscosity and flow along with the condensed steam down through the reservoir to the well through the perforations into the horizontal portion 12 of the casing where the steam and condensate flow will push the liquids along to the end of the production string. In the case of a very shallow well, it will flow back to the surface. In case of a deeper well, the jet pump will pick up the oil and condensate mixture, and lift them to the surface.

Figure 3:
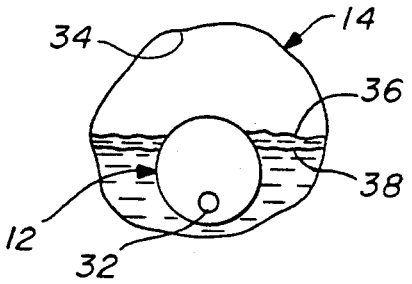
FIG. 3 is a cross section of the well and a portion of the producing zone early in the life of the well according to the preferred embodiment in this invention.

The great advantage of this invention is that a circulation passage through the horizontal portion 12 of the well casing is provided. The flow of the hot steam, water and condensate will heat the formation adjacent the casing 12. As this oil is heated, it will flow by gravity through the perforations 18 into the casing 12 where it is picked up by the steam and condensate flow to the production string for lift to the surface. By controlling the producing rate, it is possible to withdraw all of the condensate and flowable oil that enters the casing 12. The steam cavity in the producing zone 14 will continually expand and cause the oil in contact with the steam to heat and flow by gravity into the perforations 18 into the casing 12 and be recovered as described above. FIG. 3 illustrates the cross section of the horizontal portion of the well and casing 12 and a portion of the producing zone 14. A small volume of the producing zone 14 shows to have had the heavy oil liquified, flowed into the well casing 12 and been produced.

Figure 4:
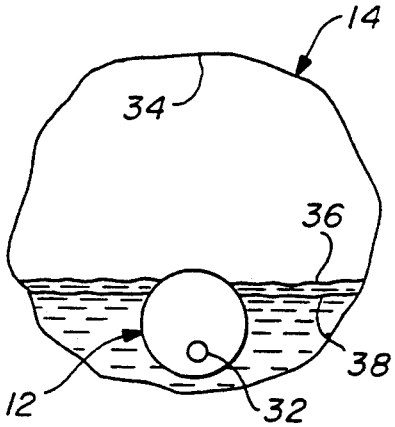
FIG. 4 is a cross section of the well and a portion of the producing zone later in the life of the well according to the preferred embodiment in this invention.

FIG. 4 shows the same cross section as FIG. 3 later in life. A larger volume of oil has been recovered from the producing zone 14.

Figure 5:
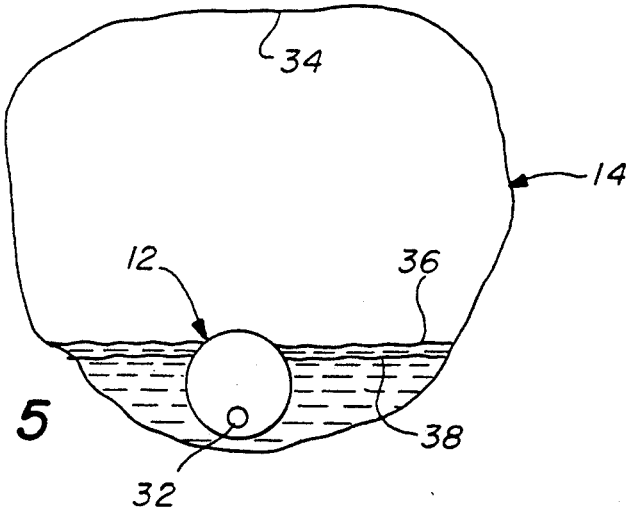
FIG. 5 is a cross section of the well and a portion of the producing zone late in the life of the well according to the preferred embodiment in this invention.

FIG. 5 shows the same cross section as FIG. 3 and FIG. 4 late in life. The heavy oil has been recovered up to the upper limit 34 of the producing zone 14. A different formation not containing hydrocarbons will lie above and define the upper limit 34 of the producing zone 14.

Figure 6:
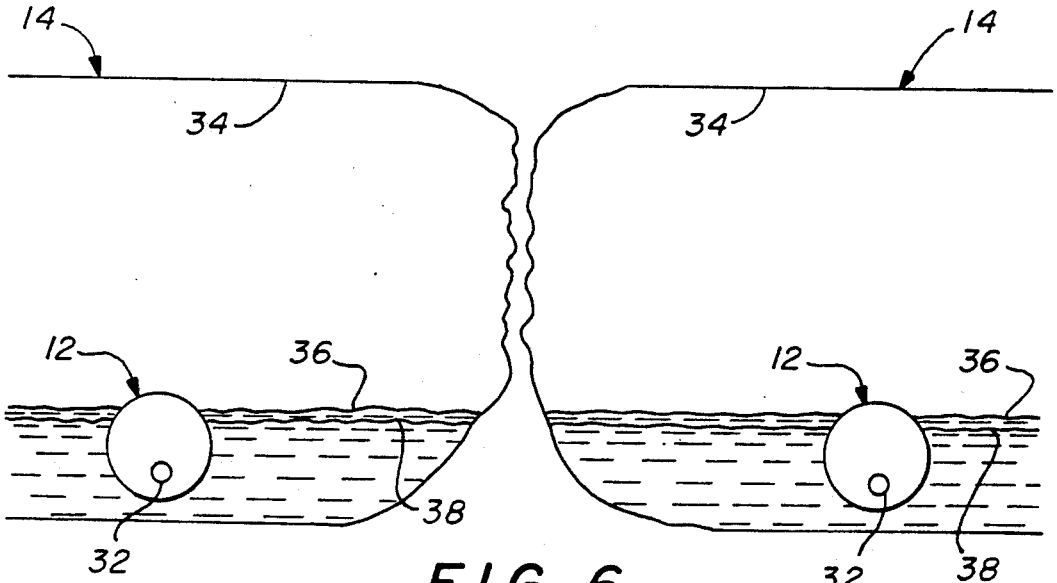
FIG. 6 is a cross section of two adjacent wells and a portion of the producing zone late in the life of the well according to the preferred embodiment in this invention.

FIG. 6 illustrates recovery which might be achieved by two parallel wells according to the invention. Very high percentages of recovery of viscous materials can be achieved economically by use of this invention as compared to conventional methods.

With this invention, the maximum economically feasible depth for steam production stimulation is greater than with a conventional vertical well. With this invention, the length of the well in which heat from the steam is lost is a smaller fraction of the total length of the length than with a vertical completion.

Referring to FIGS. 3, 4, 5 and 6, it is assumed that the oil has greater API gravity than 10, therefore the oil is lighter than the condensate water. I anticipate that in the operation of a well according to this assumption and this invention can result in a pool of condensate water and a layer of liquid hydrocarbon floating atop the condensate at the bottom of the producing zone 14. A steam vapor to oil interface 36 could exist between the pool of oil and the steam vapor in the upper volume of the producing zone 14, if the producing zone has sufficient permeability. An oil to water interface 38 could exist between the pool of oil and the water in the lower volume of the producing zone 14, if the producing zone has sufficient permeability. If the producing zone has lower permeability, the vapor-liquid interface would not be so distinctly defined.

Producing a well according to this assumption and invention would require regulation of the injection flow rate and production flow rate so that the layer of oil would enter the casing through perforations 18. Production of condensate only would indicate the bottom of the oil layer has risen above the casing. The production rate would need to be increased relative to the injection rate so the oil-condensate interface 38 would fall to the casing level and cause oil to be picked up by the jet pump 28 and pumped to the surface. If hotter condensate or steam were produced, this would indicate the production volume is too high and the production rate would need to be reduced relative to the injection rate. The relative rates described in this paragraph can be accomplished by increasing the flow that is too low, or decreasing the flow that is too high, or a combination of these adjustments.

If it is assumed that the oil has a lesser API gravity than 10, therefore the oil is heavier than the condensate water, then the oil will sink below the water, and the water will form a layer on top of the oil. gravity will then cause the oil to flow to the perforations 18. Then the jet pump can pick up the oil and lift it to the surface.

It will be understood that references to horizontal portions of a well also include a sloping portion of the well for purposes of following a sloping lower boundary of a producing zone. References to horizontal portions of a well also include any sloping portions through a producing zone, and portions of wells that slope because of circumstances at the time the well is drilled.

Although only one embodiment of the invention has been illustrated in the accompanying drawings and described in the foregoing Description of the Preferred Embodiment, it will be understood that the invention is not limited to the embodiment disclosed, but is capable of rearrangements, modifications, and substitutions and reversals of parts and elements without departing from the spirit of the invention.

I claim:

1. A system of completion for simultaneous and continuous steam injection and production of heavy oil from a single well comprising:

a well casing disposed in a well bore, the well bore and well casing having a substantially horizontal portion disposed in an earth formation containing heavy oil, and the well casing having perforations in the horizontal portion, a well head at the top end of the well casing, a packer sealing the casing between the perforations and the well head, a production tubing string extending from the well head, sealing with and communicating through the packer, an injection tubing string extending from the well head, sealing with and extending through the packer and extending through at least a portion of the perforations, such that a continuous, unobstructed, open annulus is formed between the outlet of the injection tubing string and the inlet of the injection string, inside the casing throughout the entire length of the portion of the injection tubing string below the packer, means for injecting steam into the injection string, and means for controlling the pressure of the steam and therefore the temperature of steam in the formation.

2. The system according to claim 1 wherein the means for controlling the pressure and therefore the temperature of steam in the formation includes:

a jet pump in the production string, a power fluid string extending from the well head and operably connected to the jet pump to power the jet pump, and a choke in the injection string to restrict flow, the choke positioned beyond at least a portion of the perforations in the casing.

3. The system according to claim 2 wherein the horizontal portion of the well bore and well casing is disposed in the lower portion of the earth formation containing heavy oil.

4. A method of completing a well for simultaneously and continuously injecting steam and producing heavy oil from a single well comprising:

drilling a well bore from the surface of the earth downwardly, then substantially horizontally into an earth formation containing heavy oil, placing a well casing in the well bore, perforating at least a portion of the horizontally disposed casing in the well bore, placing a well head on the casing, placing a packer in sealing engagement in the casing between the perforations and the well head, placing a production tubing string through and in sealing engagement with the packer and extending to the surface, placing an injection tubing string in the well casing and through and in sealing engagement with the packer, the interior of the casing below the packer forming a continuous, unobstructed, open annulus connected to and extending from the inlet of the production tubing string to the outlet of the injection tubing string, circulating steam down the injection string, through at least a portion of the horizontal portion of the well casing, injecting the steam upward into the earth formation containing heavy oil where it condenses, heats the heavy oil, reducing the viscosity of the heavy oil, whereby the steam condensate and hot oil flow downwardly into the horizontal portion of the well casing, controlling the steam pressure and therefore the steam temperature in the earth formation containing heavy oil by controlling the injection pressure and flow rate of the steam, and simultaneously producing the condensate and hot oil at a controlled rate through the production string.

5. The method of claim 4 wherein the step of simultaneously producing the condensate and hot oil at a controlled rate through the production string further comprises:

placing a jet pump in the production tubing string, extending a power fluid tubing string from the well head, operably connecting the power fluid tubing string to the jet pump, and pumping fluid down the power fluid string at a controlled rate to operate the jet pump.

6. The method of claim 4 wherein the step of drilling a well bore from the surface of the earth further includes the step of:

placing the horizontal portion of the well bore in the lower portion of the producing zone.

7. An improved system for completing a well and simultaneously and continuously injecting steam and producing viscous hydrocarbons including a well bore drilled downwardly, then curved to a substantially horizontal attitude in a hydrocarbon bearing zone, a well head at the surface, a casing in the well bore and perforated into the hydrocarbon bearing zone, a tubular injection string extending from the surface to a remote end of the casing, a tubular production string, a packer to seal the casing to the injection string and the production string, the packer positioned in the casing between the perforations and the well head, the interior of the casing below the packer being void of any barriers such that a continuous, unobstructed, open annulus connected to and extending from the inlet of the production tubing string to the outlet of the injection tubing string is formed, and adapted to inject steam in the injection string and thence through the perforations into the hydrocarbon bearing zone, the improvement comprising:

means for controlling the steam pressure in the hydrocarbon bearing zone.

8. An improved system for completing a well and simultaneously and continuously producing viscous hydrocarbons according to claim 7 wherein the means for controlling the steam pressure in the hydrocarbon bearing zone comprises:

a choke at the remote end of the injection string from the well head, and a jet pump in the production string to lift liquids from below the packer to the well head.

9. A system of completion for simultaneous and continuous steam injection and production of heavy oil from a single well comprising:

well casing means disposed in a well bore, the well bore and well casing means having a substantially horizontal portion disposed in an earth formation containing heavy oil, and the well casing means having perforations in the horizontal portion, well head means at the top end of the well casing means, packer means sealing the casing between the perforations and the well head means, production tubing string means extending from the well head means, sealing with and communicating through the packer means, injection tubing string means extending from the well head means, sealing with and extending through the packer means and extending through at least a portion of the perforations, the interior of the casing below the packer forming a continuous, unobstructed, open annulus connected to and extending from the inlet of the production tubing string to the outlet of the injection tubing string, and means for injecting steam into the injection tubing string means, and means for controlling the pressure of the steam and therefore the temperature of the steam in the formation, whereby steam is continuously circulated into the injection string means, out of the injection tubing string means, through a portion of the horizontal casing means, wherein injection forces drive the steam upward into the formation where it condenses, heating the heavy oil, reducing the viscosity of the heavy oil, the steam condensate and hot oil to flow downward into the horizontal portion of the well casing where the condensate and oil flow into the production tubing string means and flow through the production tubing string means to the well head simultaneously with the steam injection.

* * * * *